US006561104B2

(12) United States Patent
Nast

(10) Patent No.: US 6,561,104 B2
(45) Date of Patent: May 13, 2003

(54) BOGIE FOR RAIL VEHICLES WITH WHEELS WITH A VARIABLE TRACK

(75) Inventor: Jean-Daniel Nast, Le Creusot (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/108,637

(22) Filed: Mar. 29, 2002

(65) Prior Publication Data

US 2002/0139276 A1 Oct. 3, 2002

(30) Foreign Application Priority Data

Apr. 2, 2001 (FR) ..... 01 04460

(51) Int. Cl.[7] ..... B61F 7/00
(52) U.S. Cl. ..... 105/178; 105/218.2
(58) Field of Search ..... 105/133, 138, 105/140, 34.1, 178, 179, 182.1, 218.2

(56) References Cited

U.S. PATENT DOCUMENTS 4,388,872 A * 6/1983 Girod et al. ..... 105/133
5,181,473 A * 1/1993 Petit et al. ..... 105/133
5,816,170 A * 10/1998 Lopez Gomez et al. .... 105/178

FOREIGN PATENT DOCUMENTS

| | | |
|---|---|---|
| AT | 398 557 B | 12/1994 |
| DE | 198 19 467 A | 11/1999 |
| EP | 0 013 895 A | 8/1980 |
| EP | 0 308 720 A | 3/1989 |
| WO | WO 96 37397 A | 11/1996 |

* cited by examiner

*Primary Examiner*—Mark T. Le
(74) *Attorney, Agent, or Firm*—Sughrue Mion, PLLC

(57) ABSTRACT

A bogie for rail vehicles with wheels with a variable track includes a chassis supporting a body of the vehicle and four wheels connected to the chassis by articulated arms. Each wheel is movable transversely relative to the articulated arm to occupy at least two positions corresponding to two different track gages and the arms are able to pivot about a pivot with a movement damped by primary suspension members. At least one articulated arm transmits rotation of the wheel to a secondary shaft and the secondary shaft is constrained to rotate with a braking and/or traction system.

11 Claims, 5 Drawing Sheets

BOGIE FOR RAIL VEHICLES WITH WHEELS WITH A VARIABLE TRACK

BACKGROUND OF THE INVENTION

1. Field of the Invention

The invention relates to a bogie for rail vehicles with a variable wheel track and more particularly to a bogie including a chassis carrying the body of the vehicle and four wheels connected to the chassis by articulated arms, each wheel being movable transversely relative to its support arm so that the wheel track of the bogie can be quickly adapted to the difference in track gage between some rail networks.

2. Description of the Prior Art

The document EP-B1-0 591 088 discloses a rail vehicle support bogie with a variable wheel track and including a central chassis and four oscillating arms joined to the central chassis. Each of the arms supports a transversely mobile set of bearings enabling the wheels of the bogie to be placed in two positions corresponding to two different track gages. However, this kind of bogie has the disadvantage that it cannot be adapted to receive traction motors. Accordingly, although with this kind of bogie it is possible to modify the wheel track of non-motor vehicles, it is still necessary to change the motor unit for a motor unit suited to the new track gage when a train is being readied for transfer onto a network having a different track gage. Changing the motor unit considerably complicates logistics and is not compatible with optimum use of rolling stock.

An object of the present invention is therefore to propose a variable wheel track bogie which can, without modifying its structure, be used as a support bogie or as a motor bogie, so that it can be fitted to either traction vehicles or non-motor vehicles.

Another object of the invention is to propose a variable wheel track bogie that is suitable for rail vehicles travelling at high speeds (in excess of 300 kph) and in particular new vehicles in which the motive power is divided between all of the bogies of the vehicles.

SUMMARY OF THE INVENTION

The invention provides a bogie for rail vehicles with wheels with a variable track and including a chassis supporting a body of the vehicle and four wheels connected to the chassis by articulated arms, wherein each wheel is movable transversely relative to the articulated arm to occupy at least two positions corresponding to two different track gages and the arms are able to pivot about a pivot with a movement damped by primary suspension members, wherein at least one articulated arm includes means for transmitting rotation of the wheel to a secondary shaft and the secondary shaft is constrained to rotate with a braking and/or traction system.

Particular embodiments of the bogie according to the invention can have one or more of the following features in isolation or in all technically feasible combinations:

- the braking and/or traction system is carried by a member that is suspended relative to the articulated arm;
- the braking and/or traction system is fixed directly to the chassis of the bogie;
- the secondary shaft is connected to the braking and/or traction system by a universal joint;
- braking and/or traction system includes a disk brake;
- the braking and/or traction systems includes a traction motor;

- the traction motor is fixed directly to the body of the vehicle;
- each articulated arm supports a half-axle mounted on a transversely mobile set of bearings enabling the wheels of the bogie to be moved;
- a cross-member is fixed between two articulated arms;
- the transmission means consist of a gear train disposed in the articulated arm and the articulated arm has a hollow structure forming a transmission housing;
- the secondary shaft is disposed near the pivot of the articulated arm.

The objects, aspects and advantages of the present invention will be better understood from the following description of one particular embodiment of the invention, given by way of non-limiting example and with reference to the accompanying drawings.

DETAILED DESCRIPTION OF THE PREFERRED EMBODIMENT

To make the drawings easier to read, only parts necessary to understanding the invention are shown. The same parts are identified by the same reference numbers in all the figures.

Figure 1:
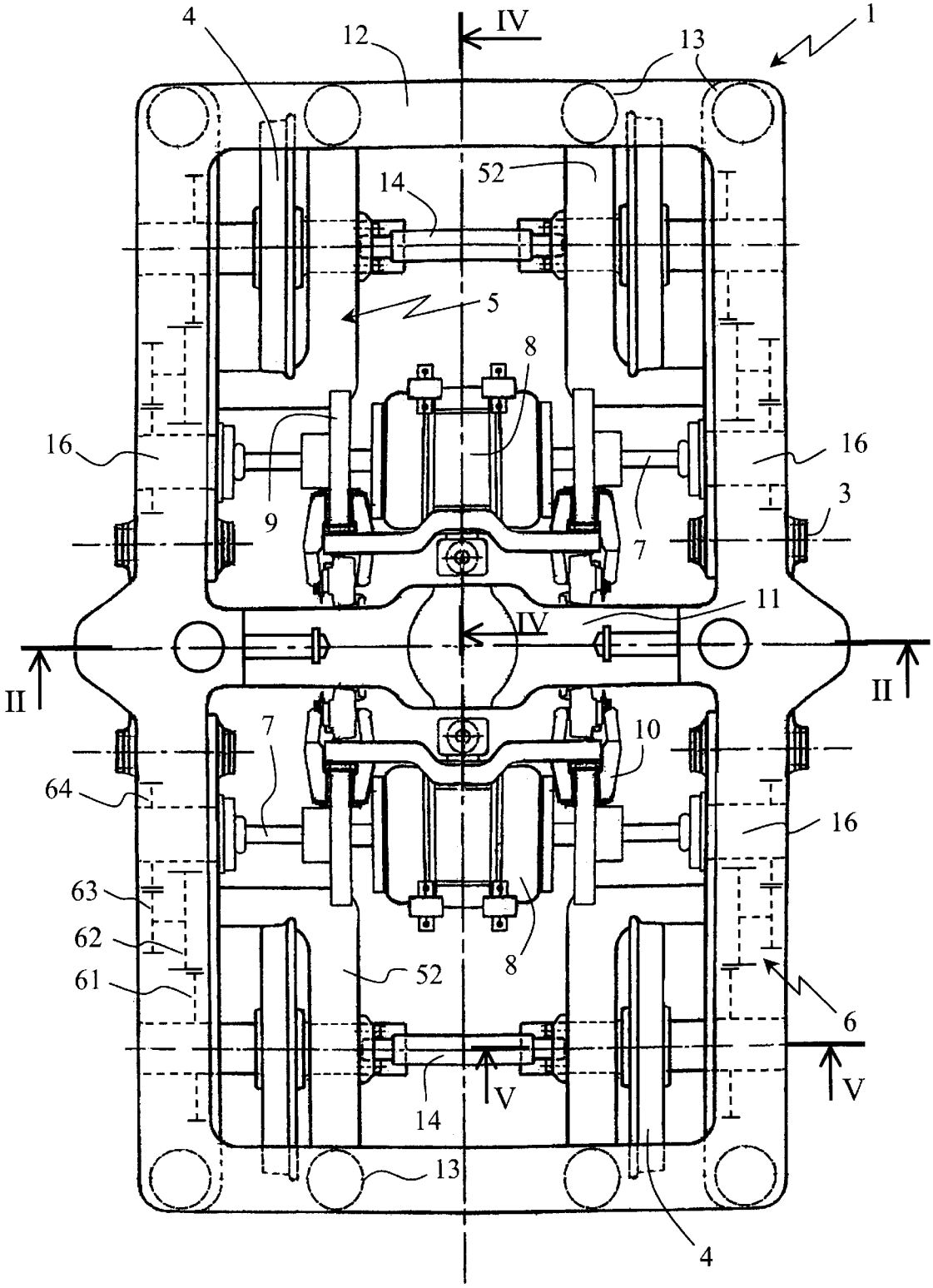
FIG. 1 is a plan view of one particular embodiment of a four-wheel bogie in accordance with the invention with the wheels in a position corresponding to the narrowest track gage.
Figure 2:
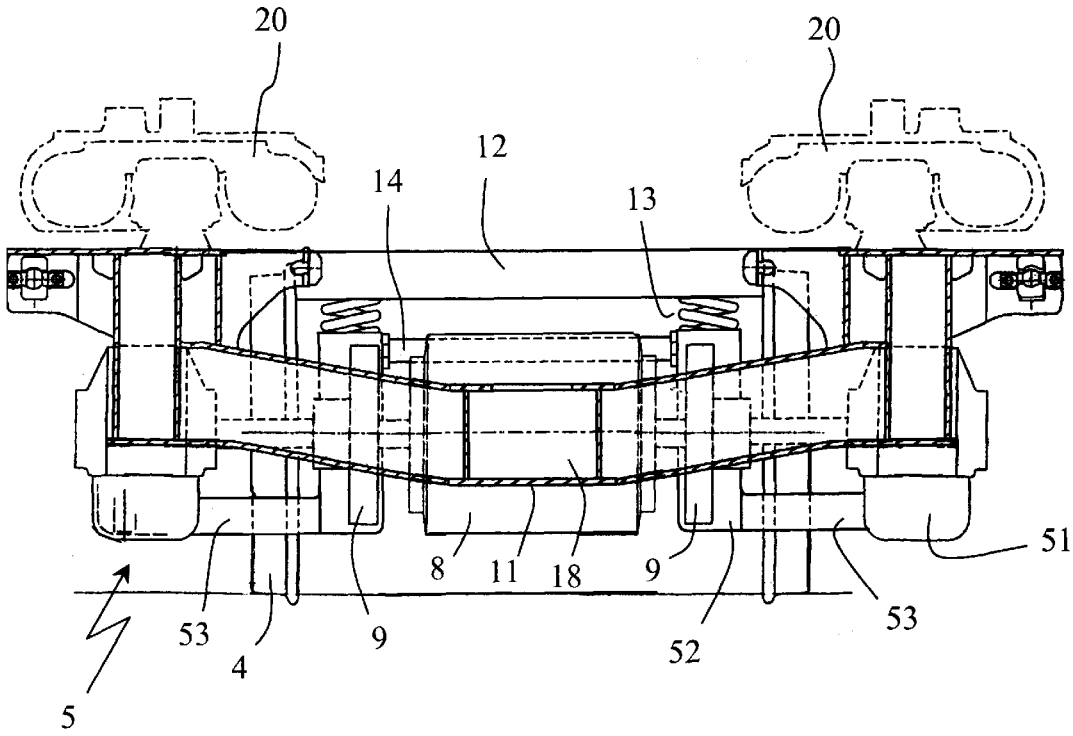
FIG. 2 is a view in section taken along the line II—II in FIG. 1.

FIGS. 1 and 2 show a bogie with four wheels 4 for a rail vehicle including a chassis 1 for supporting the body of the vehicle and consisting of a central crossbeam 11 joined at its ends to a rectangular frame 12 delimiting the perimeter of the chassis 1 of the bogie. The frame 12 is formed of two longitudinal members and two cross-members. The connections between the wheels 4 and the chassis 1 are made by four articulated arms 5 under the chassis 1. The four arms 5 each have a first end 51 and a second end 52 connected together by a cross-member 53. The combination of the first branch 51, the second branch 52 and the cross-member 53 forms a fork in which one of the wheels 4 is disposed and which is open towards the outside and extends longitudinally relative to the bogie.

Figure 3:
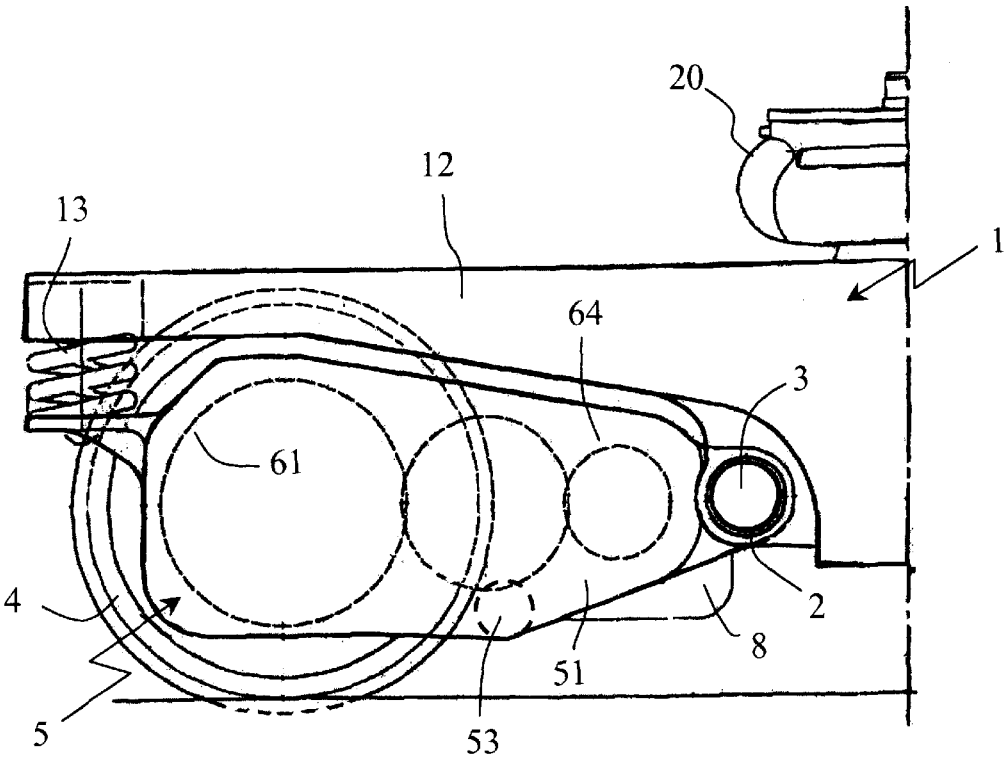
FIG. 3 is an external side view of part of the bogie shown in FIG. 1.
Figure 4:
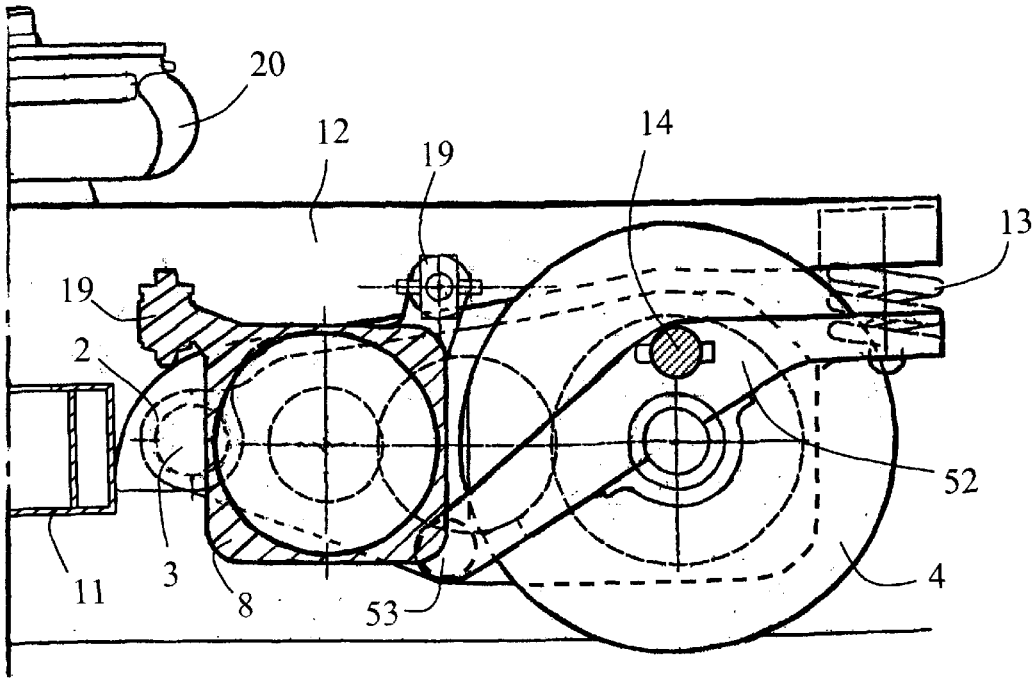
FIG. 4 is a view of part of the bogie in section taken along the line IV—IV in FIG. 1.

As shown in FIGS. 3 and 4, each first branch 51 is vertically aligned with one of the longitudinal members of the frame 12 and has one end articulated to the chassis 1 by means of a bearing 2 receiving a pivot 3 fastened to the frame 12 and disposed near the central cross-member 11. The first branches 51 extend from the pivot 3 to the longitudinal end of the chassis 1 and the top faces of the free ends of the first branches 51 support a coil spring 13 on which the frame 12 rests.

The second branch 52 of each of the articulated arms 5 is shorter and less bulky than the first branch 51. It is parallel to the first branch 51 and extends inside the bogie from the cross-member 53 to a point near the longitudinal end of the chassis 1. The free ends of the second branches 52 also support coil springs 13 on which the frame 12 rests. The combinations of the coil springs 13 of the articulated arms 5 constitute primary suspension members.

The articulated arms 5 disposed side-by-side on the bogie are interconnected by a cross-member 14 which is fixed laterally to the second branch 52, increases the structural stiffness of the articulated arms 5 and guarantees a constant spacing between the two articulated arms 5.

As shown in FIG. 3, the first branch 51 includes a body having a large volume which constitutes a transmission housing in which is disposed a gear train 6 for transmitting rotation between the wheel 4 and a secondary shaft 16 disposed near the pivot 3.

The secondary shaft 16 of each articulated arm 5 is open towards the inside of the frame 12, as shown in FIG. 1, and is connected by a universal joint 7 to an output shaft of a traction motor 8 fixed directly under the body of the vehicle on Silentbloc mounts 19. However, in another embodiment, not shown, the traction motor 8 is fixed directly to the chassis 1 of the bogie and in particular to the central cross-member 11.

In the advantageous particular embodiment shown in the figures, a single traction motor 8 drives the wheels 4 of the two articulated arms 5 disposed side-by-side on the bogie. The traction motor 8 is centered on the longitudinal axis of the bogie and has an output shaft at each end.

Each of the output shafts of the traction motor 8 includes a disk 9 cooperating with a brake caliper 10 fixed directly to the central cross-member 11 of the chassis 1, or fixed to the structure of the traction motor 8 in the embodiment, not shown, in which the traction motor 8 is fixed directly to the chassis 1, the combination constituting a disk brake for braking the output shaft of the traction motor 1 and therefore the wheel 4 which is coupled to it by the gear train 6 and the universal joint 7.

As shown in FIG. 2, the top face of the frame 12 of the bogie supports secondary suspension members 20 shown in chain-dotted outline in the figure and disposed between the body and the chassis. The body is driven and allowed to turn by conventional means such as a central drive pivot, not shown, accommodated in a housing 18 in the central cross-member 11.

Figure 5:
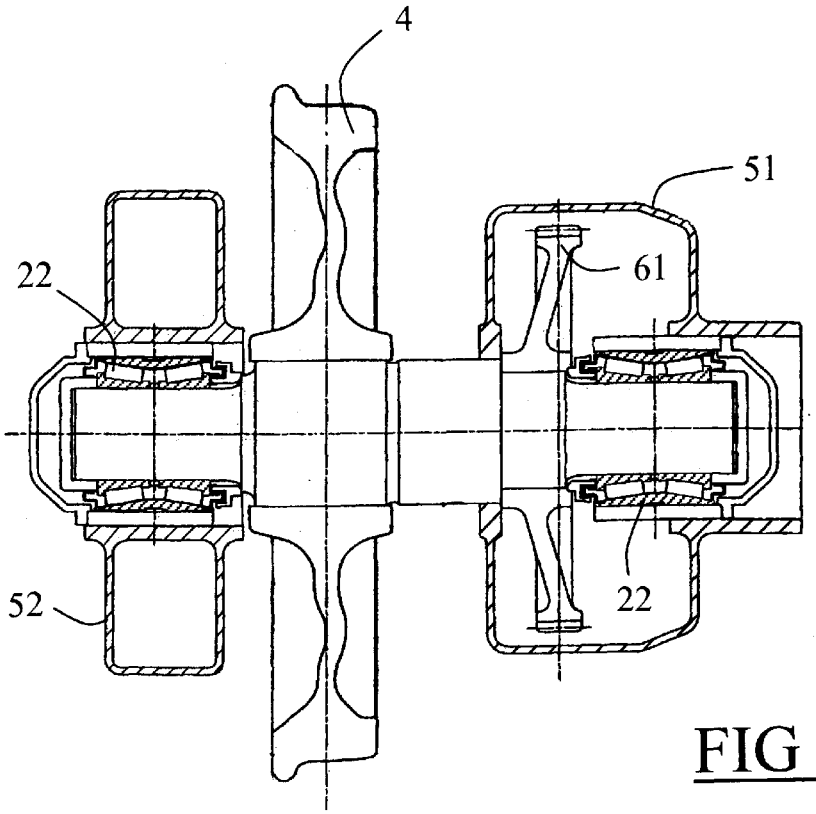
FIG. 5 is a diagrammatic view in section taken along the line V—V in FIG. 1 showing the housings of the sets of bearings for the wheels.

FIG. 5 shows an articulated arm 5 in section at the location of the axis of the wheel 4. In this figure the arm 5 supports a half-axle fastened to the wheel 4 and mounted on two transversely mobile sets of bearings 22 in housings in the first branch 51 and the second branch 52. The mobile sets of bearings 22 enable the half-axle and therefore the wheel 4 to be moved into two positions corresponding to two different track gages.

Figure 7:
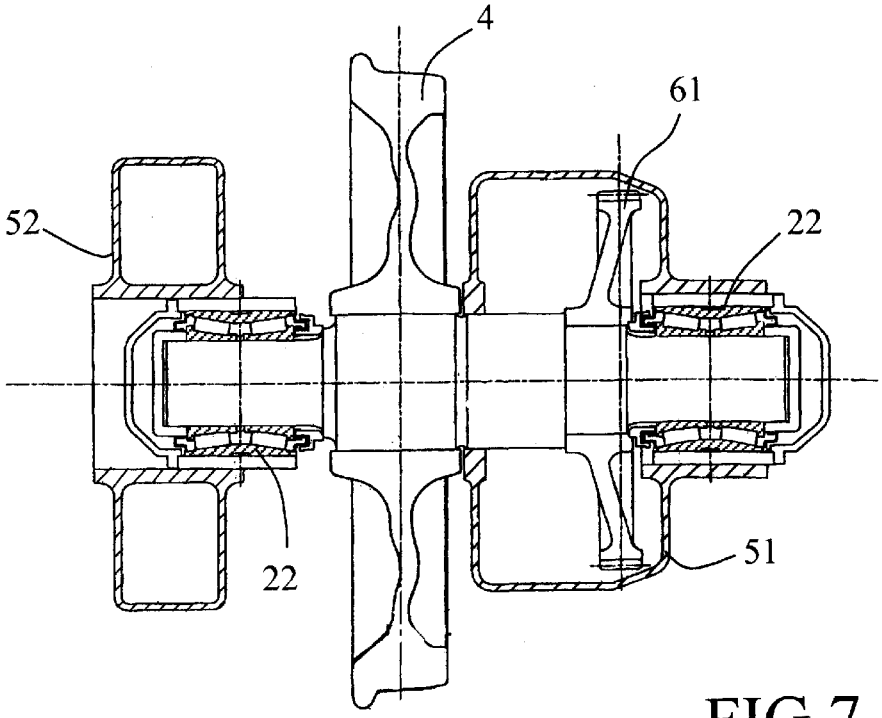
FIG. 7 is a similar view in section taken along the line VII—VII in FIG. 6.
Figure 6:
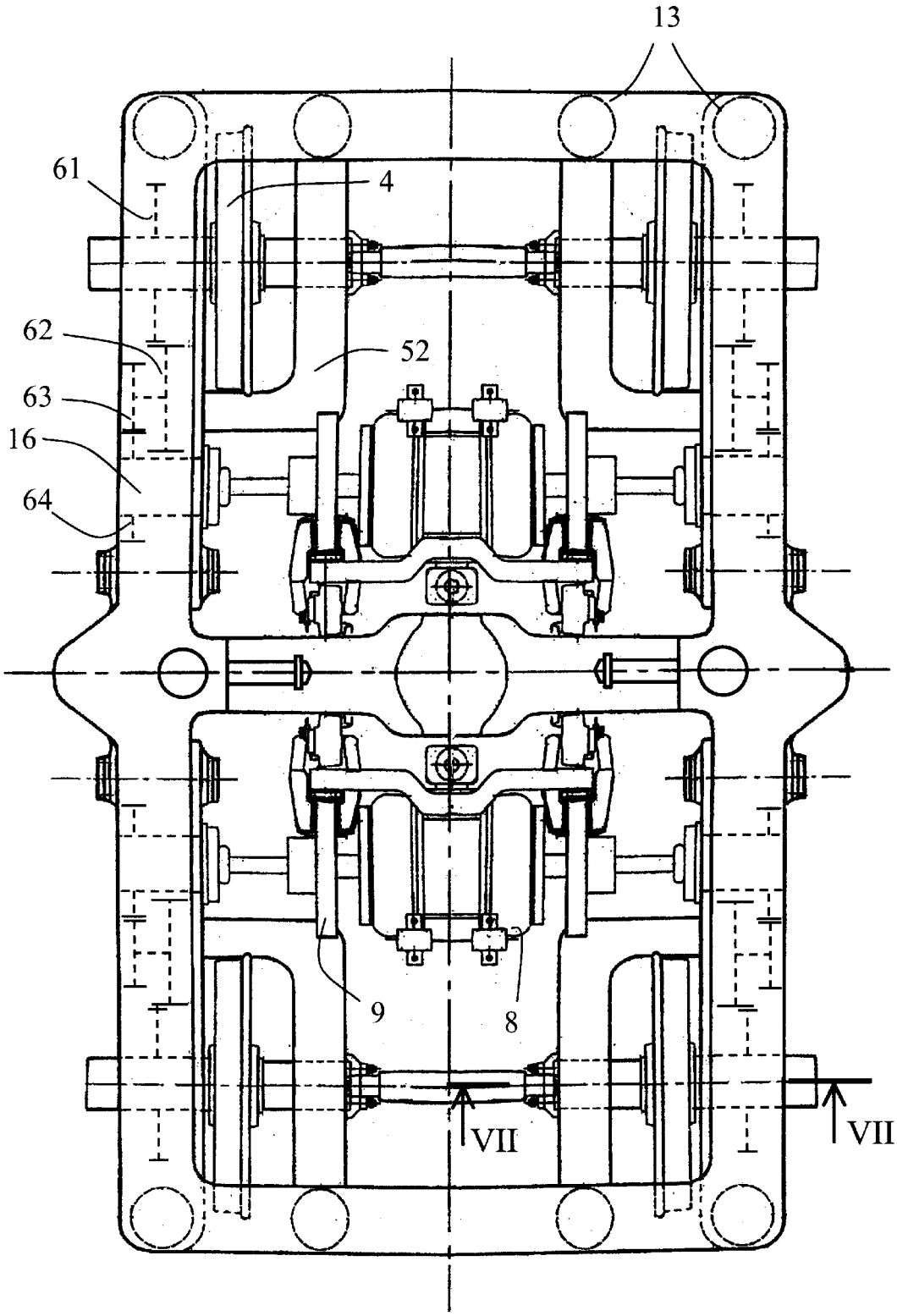
FIG. 6 is a view similar to FIG. 1 with the wheels in a position corresponding to the widest track gage.

In FIGS. 1 to 5 the wheels 4 are shown in a position corresponding to the narrowest track gage and in FIGS. 6 and 7 the wheels 4 are shown in a position corresponding to the widest track gage. The wheels 4 are locked in a particular position by transversely locking the sets of bearings 22 with locking means, not shown, such as locking fingers that can be manipulated from the outside and are inserted into the bodies of the first and second branches 51 and 52 to constitute abutments locking the sets of bearings 22 laterally. This kind of locking means is described in patent application FR 1 558 329, for example.

As shown in FIGS. 5 and 7, the half-axle includes a gear 61 that is part of the gear train 6 for transmitting rotation from the wheel 4 to the secondary shaft 16. The gear 61 is accommodated in the transmission housing formed by the body of the first branch 51 and follows transverse movements of the half-axle. The gear 61 cooperates with a second gear 62, shown diagrammatically in dashed outline in FIGS. 1 and 6, which is immobile transversely and wider, to enable it to mesh with the gear 61 in both transverse positions of the half-axle. The second gear 62 is constrained to rotate with another gear 63 cooperating with a complementary gear 64 fastened to the secondary shaft 16.

The resulting bogie can adapted to two different track gages by operating in a manner that is known on the art with the aid of a fixed installation employing rails and counter-rails, for example, situated at the place of transition from one track gage to the other. The wheel track is therefore changed by releasing the sets of bearings of the bogies from their locking means and moving the train at low speed through the installation. The rails and counter-rails then guide transverse movements of the wheels. This kind of installation is described in patent FR 1 548 462, for example.

The bogie according to the invention has the advantage that it can be used as a motor bogie by coupling the secondary shaft of the articulated arms to a traction motor, as in the embodiment specifically described, but that it can equally well be used as a support bogie by retaining the same bogie structure and connecting the secondary shaft to a simple braking system consisting, for example, of a shaft equipped with brake disks and coupled to the universal joints in a manner similar to that previously described. If the bogie according to the invention is used as a support bogie, the shaft supporting the brake disks is guided by one or more bearings, for example, advantageously connected directly to the chassis and in particular to the central cross-member.

The above kind of bogie also has the advantage of being suitable for the new high-speed trains in which motive power is divided between the bogies, this distribution of the motive power having the advantages of a better distribution of mass and of enabling a greater number of passengers to be carried, because passengers can be carried in all of the vehicles constituting the train.

Of course, the invention is in no way limited to the embodiment described and shown by way of example only. Modifications are possible, in particular with regard to the construction of the various components or by substituting technical equivalents, without departing from the scope of the protection afforded to the invention.

Thus in one embodiment, not shown, the bogie according to the invention with variable wheel track can be equipped with a traction motor for each wheel. In this case, the motor can advantageously be fixed directly to the articulated arm with the output shaft of the motor connected directly to the secondary shaft of the articulated arm.

There is claimed:

1. A bogie for rail vehicles with wheels with a variable track and including a chassis supporting a body of the vehicle and four wheels connected to said chassis by articulated arms, wherein each wheel is movable transversely relative to the articulated arm to occupy at least two positions corresponding to two different track gages and the arms are able to pivot about a pivot with a movement dampened by primary suspension members, wherein at least one articulated arm includes a secondary shaft and means for transmitting rotation of the wheel to said secondary shaft and said secondary shaft is constrained to rotate with a braking and/or traction system.

2. The rail vehicle bogie claimed in claim 1, wherein said braking and/or traction system is carried in one of a housing contained by or attached to the articulated arms.

3. The rail vehicle bogie claimed in claim 2, wherein said braking and/or traction system is adapted to be fixed to the chassis of the bogie.

4. The rail vehicle bogie claimed in claim 1, wherein said secondary shaft is connected to said braking and/or traction system by a universal joint.

5. The rail vehicle bogie claimed in claim 1, wherein said braking and/or traction system includes a disc brake.

6. The rail vehicle bogie claimed in claim 1, wherein the braking and/or traction systems includes a traction motor.

7. The rail vehicle bogie claimed in claim 6, wherein said traction motor is adapted to be fixed to the body of the vehicle.

8. The rail vehicle bogie claimed in claim 1, wherein each articulated arm supports a half-axle mounted on a transversely mobile set of bearings enabling the wheels of the bogie to be moved.

9. The rail vehicle bogie claimed in claim 8, wherein a cross-member is fixed between two articulated arms.

10. The rail vehicle bogie claimed in claim 1, wherein said transmitting means comprises a gear train disposed in said articulated arm, the articulated arm having a hollow structure forming a transmission housing.

11. The rail vehicle bogie claimed in claim 1, wherein said secondary shaft is disposed near the pivot of the articulated arm.

* * * * *